US009669982B2

(12) United States Patent
Doering et al.

(10) Patent No.: US 9,669,982 B2
(45) Date of Patent: Jun. 6, 2017

(54) CMP BRUSH PACKAGING

(71) Applicant: ENTEGRIS, INC., Billerica, MA (US)

(72) Inventors: Patrick Doering, Holliston, MA (US); David Trio, Dracut, MA (US); Chintan Patel, Lowell, MA (US); Chester L. Bejtlich, Reading, MA (US); Christopher Vroman, Shrewsbury, MA (US); Bradley H. Wood, Waltham, MA (US); Matthew B. Nicolas, Belle Plaine, MN (US)

(73) Assignee: Entegris, Inc., Billerica, MA (US)

( * ) Notice: Subject to any disclaimer, the term of this patent is extended or adjusted under 35 U.S.C. 154(b) by 0 days.

(21) Appl. No.: 14/432,457

(22) PCT Filed: Sep. 28, 2013

(86) PCT No.: PCT/US2013/062495
§ 371 (c)(1),
(2) Date: Mar. 30, 2015

(87) PCT Pub. No.: WO2014/052941
PCT Pub. Date: Apr. 3, 2014

(65) Prior Publication Data

US 2015/0251834 A1 Sep. 10, 2015

Related U.S. Application Data

(60) Provisional application No. 61/707,526, filed on Sep. 28, 2012.

(51) Int. Cl.
*B65D 77/04* (2006.01)
*B65B 5/04* (2006.01)
(Continued)

(52) U.S. Cl.
CPC ..... *B65D 77/0426* (2013.01); *B65B 5/04* (2013.01); *B65B 55/00* (2013.01); *B65D 85/00* (2013.01);
(Continued)

(58) Field of Classification Search
CPC ..... A47L 13/16; A47L 13/17; B65D 75/002; B65D 75/006; B65D 77/04; B65D 77/0426; B65D 85/00; B65D 85/672; B65D 5/04
(Continued)

(56) References Cited

U.S. PATENT DOCUMENTS 2,813,286 A * 11/1957 Strader ..... A47L 13/38 206/361
3,374,882 A * 3/1968 Amaliksen ..... B65D 75/002 15/244.1
(Continued)

FOREIGN PATENT DOCUMENTS

CN 1355929 A 6/2002
CN 1436145 A 8/2003
(Continued)

*Primary Examiner* — Bryon Gehman
(74) *Attorney, Agent, or Firm* — Entegris, Inc. Legal Dept.; Catherine D. Gates

(57) ABSTRACT

A method of packaging a CMP brush having a cylindrical brush portion and a pair of end connection portions. The method includes saturating the brush with a liquid; covering the cylindrical brush portion with a flexible sheet that extends around and engages the surface of the cylindrical portion; engaging each of the end connection portions with a respective end support; inserting the dampened brush into a rigid polymer tubular shipping container and supporting the end connection portions within the polymer tube; and providing an additional exterior self-supporting packaging.

6 Claims, 5 Drawing Sheets

(51) Int. Cl.
*B65B 55/00* (2006.01)
*B65D 85/00* (2006.01)

(52) U.S. Cl.
CPC ..... *B65B 2220/16* (2013.01); *B65B 2220/18* (2013.01)

(58) Field of Classification Search
USPC ..... 15/244.1, 244.3, 244.4; 206/361, 362.2
See application file for complete search history.

(56) References Cited

U.S. PATENT DOCUMENTS 3,987,897 A * 10/1976 Smith ..... B65D 85/672 206/497
4,151,914 A * 5/1979 Blatt ..... B65D 85/66 206/386
4,852,732 A 8/1989 Wilski et al.
5,020,664 A * 6/1991 Hughes ..... B65D 85/08 206/361
5,542,534 A * 8/1996 Dinter ..... B65D 85/672 206/407
5,701,999 A 12/1997 Phillips, II et al.
6,076,662 A 6/2000 Bahten
7,337,592 B2 * 3/2008 Inoue ..... B32B 27/08 53/403
7,955,693 B2 * 6/2011 Drury ..... B29C 44/385 15/244.1
2006/0000191 A1 1/2006 Inoue et al.
2006/0283770 A1 12/2006 Schauer
2007/0095712 A1 5/2007 Miles

FOREIGN PATENT DOCUMENTS

GB 597242 A 1/1948
JP H11-255261 A 9/1999
WO 86/03470 A1 6/1986
WO 87/03558 A1 6/1987
WO WO 93/24394 A1 12/1993

* cited by examiner

CMP BRUSH PACKAGING

RELATED APPLICATIONS

The present application is a National Phase entry of PCT Application No. PCT/US2013/062495, filed Sep. 28, 2013, which claims priority to U.S. Provisional Application No. 61/707,526 filed on Sep. 28, 2012, the disclosures of which are incorporated by reference in their entireties.

FIELD OF THE INVENTION

The present invention is generally directed to semiconductor manufacturing. More specifically, the present invention is directed to apparatuses, systems, and methods for handling and packaging chemical mechanical planarization (CMP) brushes.

BACKGROUND OF THE INVENTION

There remains a continuing need for better cleanliness in semiconductor manufacturing environments. One particular area includes the mounting of chemical mechanical planarization (CMP) cleaning brushes onto process tools. Handling of brushes removed from standard packaging by gloved worker hands followed by mounting the brushes on the tool can introduce contaminants onto the brush surfaces and onto nodules from the gloves. The brush comes into contact with the substrate (semiconductor wafer, flat panel display, hard disk and the like) during cleaning such that it is highly desirable that brush surfaces be clean and minimize any added particles, metal ionic contaminants, and organic contaminants during shipping and installation. Since many CMP brushes are shipped in a wet or dampened state to maintain compressibility of the brush's sponge material, packing should also provide an environment that preserves the brush's chemical and physical properties, such as eliminating deformation of nodules on the brush's cylindrical surface during shipment as the foam material used in such brushes may have memory characteristics.

Known packaging methods and systems, such as those utilizing a clamshell package, seal the moistened brush within a polymeric shell. When a user opens the packaging, the CMP brush may be grasped by the user. However, grasping the brush may cause the brush to become contaminated, so in such a situation, the user must be careful to only grasp the brush at its ends, rather than at the brush surface. Such clam shell packaging may be susceptible to damage to the integrity of the packaging when dropped.

Such systems constrain the user to handling the brush in a manner that can be extremely difficult, and that often results in accidental contact with brush nodules and brush surfaces intended to clean substrate surfaces. Moreover, a more robust packaging system that can survive drop tests used in the industry would be desirable.

SUMMARY

Embodiments of the claimed invention make up for the shortcomings of known CMP brush packaging systems by not only providing mechanical and chemical protection during shipping and storage, but also by providing methods for users to grasp the CMP brush while still partially protected by packaging elements, such that it can safely be placed onto a process tool without contamination.

Embodiments of the invention include packaging for a CMP brush on a core that is at least partially covered by a loose polymeric sleeve or flexible sheet that has one or more slits, or one or more perforations, in the sheet that allow the sheet to be removed from the brush while it is mounted on the tool by a user. The polymeric sleeve or sheet allows the brush on the core to be mounted on the tool without the need for gloves and minimizes or eliminates adding contaminants to the brush surface (for example if scissors were used to open the sleeve). The flexible sheet may cover as much of the CMP brush as necessary for a worker to handle the brush.

The CMP brush that is partially covered by the flexible sheet can be further contained in a liquid-tight sealed outer wrap, such as a polymeric container, which in some embodiments comprises a polymeric bag. In an embodiment, the outer wrap may include a tear notch at one end that allows opening of the outer wrap without the need for scissors or other contamination-introducing tools. The outer wrap is liquid tight and can contain water and/or other preservatives like hydrogen peroxide or ammonium hydroxide.

In an embodiment, the outer wrap, which in an embodiment comprises a polymeric container, has an opening and internal dimensions that allow it to accommodate a sleeve covered CMP brush on a core wherein the core can have one or more removable end-support structures mounted to the ends of the brush. These end-supports may comprise disks, rings or other geometric structures that when mounted to the brush core, keep the brush and brush nodules offset from a surface, such as a surface of a tubular shipping container. Offsetting the brush from a surface protects the nodules from deformation during shipping and handling. In some embodiments the flexible sheet can cover the support structures, though in other embodiments, the flexible sheet only covers a cylindrical portion of the brush.

An outer housing, such as a tubular shipping container, can be placed around the CMP brush, with optional support structures on its ends, that is partially covered by the polymeric sleeve or flexible sheet with one or more slits. The outer housing provides protection to the brush during shipping. The outer housing or tubular shipping contain may have a geometric cross section that allows the CMP brush with end supports mounted to the brush to be placed within the housing or tubular shipping container; the end supports can keep brush surfaces and nodules from touching an inside surface of the outer housing/tubular shipping container. The outer housing can have one or more caps that retain the CMP brush in the housing.

In some embodiments, the outer housing may have end caps that also function as the support structures. The brush can be fit into or adjacent these support structures during packaging. This advantageously can reduce the amount of packing material.

The claimed invention includes a number of embodiments, including a method of packaging a CMP brush having a cylindrical brush portion and a pair of end connection portions, the method comprising: at least dampening the brush with a liquid; covering the cylindrical brush portion with a flexible sheet that extends around and engages the surface of the cylindrical portion; engaging each of the end connection portions with a respective end support, the end supports having a flange portion with a diameter greater than a maximum diameter of the cylindrical portion; inserting the dampened brush into a rigid polymer tubular shipping container having a tubular wall with an inside surface, whereby the end supports keep the cylindrical brush portion from contact and from deformation of the cylindrical portion by the tubular wall; and providing an additional exterior self-supporting packaging around the rigid polymer shipping container.

In an embodiment, the claimed invention may also comprise a packaged CMP brush, the brush comprising a cylindrical brush portion with a cylindrical surface and a pair of end connection portions, the packaging comprising: a flexible polymer sheet material extending around the cylindrical portion and circumferentially engaging and covering the cylindrical portion; a pair of end support portions supportingly engaging each of the end connection portions, each end support portion having a central engagement feature in engagement with the end connection portion and a flange portion extending radially beyond the radial extent of the cylinder; a rigid polymer shipping container, the end support portions engaging the ends of the polymer shipping container whereby the brush is suspended therein with the cylindrical surface spaced from the rigid polymer shipping container; and the rigid polymer shipping container hermetically sealed.

In an embodiment, the claimed invention also includes a method of unpacking and installing a CMP brush, from a CMP package, the CMP package comprising the CMP brush having a dampened cylindrical foam portion and two opposite end portions, the packaging comprising a polymer sheet material wrapping and engaging the cylindrical portion, a pair of end support portions engaging the opposite end portions of the CMP and engaged with a self-supporting shipping container; the method comprising: removing the CMP brush with supports from the self-supporting polymer shipping container, removing the end supports from the cylindrical brush while retaining the polymer sheet material wrapping the cylindrical brush portion, manually grasping the cylindrical brush by way of the polymer sheet material wrapping the cylindrical brush portion such the surface of the brush portion is not contacted by the users hand; affixing the brush to the brush fixture whilst holding the cylindrical brush by way of the polymer sheet material, and removing the polymer sheet material.

In an embodiment, the claimed invention comprises a method of packaging a CMP brush having a cylindrical brush portion with radially extending nodules and a pair of end connection portions, the method comprising: covering the cylindrical brush portion with a flexible sheet that extends around and engages the nodules without deforming the nodules; engaging each of the end connection portions with a respective end support, the end supports having a flange portion with a diameter greater than a maximum diameter of the cylindrical portion; inserting the brush into a rigid polymer tubular shipping container having a tubular wall with an inside surface, whereby the end supports keep the nodules from contact and from deformation of the cylindrical portion by the tubular wall; and providing an additional exterior self-supporting packaging around the rigid polymer shipping container.

In an embodiment, the claimed invention also comprises a method of shipping a CMP brush having a cylindrical brush portion with nodules and a pair of end connection portions, the method comprising: providing three polymer coverings to the cylindrical brush portion: one being a non-self-supporting wrap wrapped around the cylindrical portion and engaging the nodules; another one being a sealed bag; and the final one being a tubular shipping container sized with an inside diameter larger than a maximum diameter of the brush portion; enclosing the cylindrical brush portion within the three polymer coverings.

In an embodiment, the claimed invention also comprises a method of protecting a CMP brush having a cylindrical brush portion with radially extending nodules and a pair of end connection portions, the method comprising: having the brush dampened; wrapping the cylindrical brush portion and nodules with a non-self supporting wrap whereby the cylindrical brush may be grasped by a user's hand without the hand directly contacting the brush.

In an embodiment, the claimed invention comprises a packaged CMP brush, the brush having a cylindrical brush portion with nodules and a pair of end connection portions, the packaging comprising: three polymer coverings to the cylindrical brush portion, the three polymer coverings comprising: a non-self supporting wrap wrapped around the cylindrical portion and engaging the nodules without deforming the nodules; a sealed bag; and a rigid tubular shipping container sized with an inside diameter larger than a maximum diameter of the brush portion; wherein the CMP brush is sealingly enclosed in the rigid tubular shipping container and spaced from a tubular wall of the container.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF DRAWINGS

The drawings accompanying and forming part of this specification are included to depict certain aspects of the invention. A clearer impression of the invention, and of the components and operation of systems provided with the invention, will become more readily apparent by referring to the exemplary, and therefore non-limiting, embodiments illustrated in the drawings, wherein identical reference numerals designate the same components. Note that the features illustrated in the drawings are not necessarily drawn to scale.

The invention can be understood in consideration of the following detailed description of various embodiments of the invention in connection with the accompanying drawings, in which.

DETAILED DESCRIPTION

Figure 1:
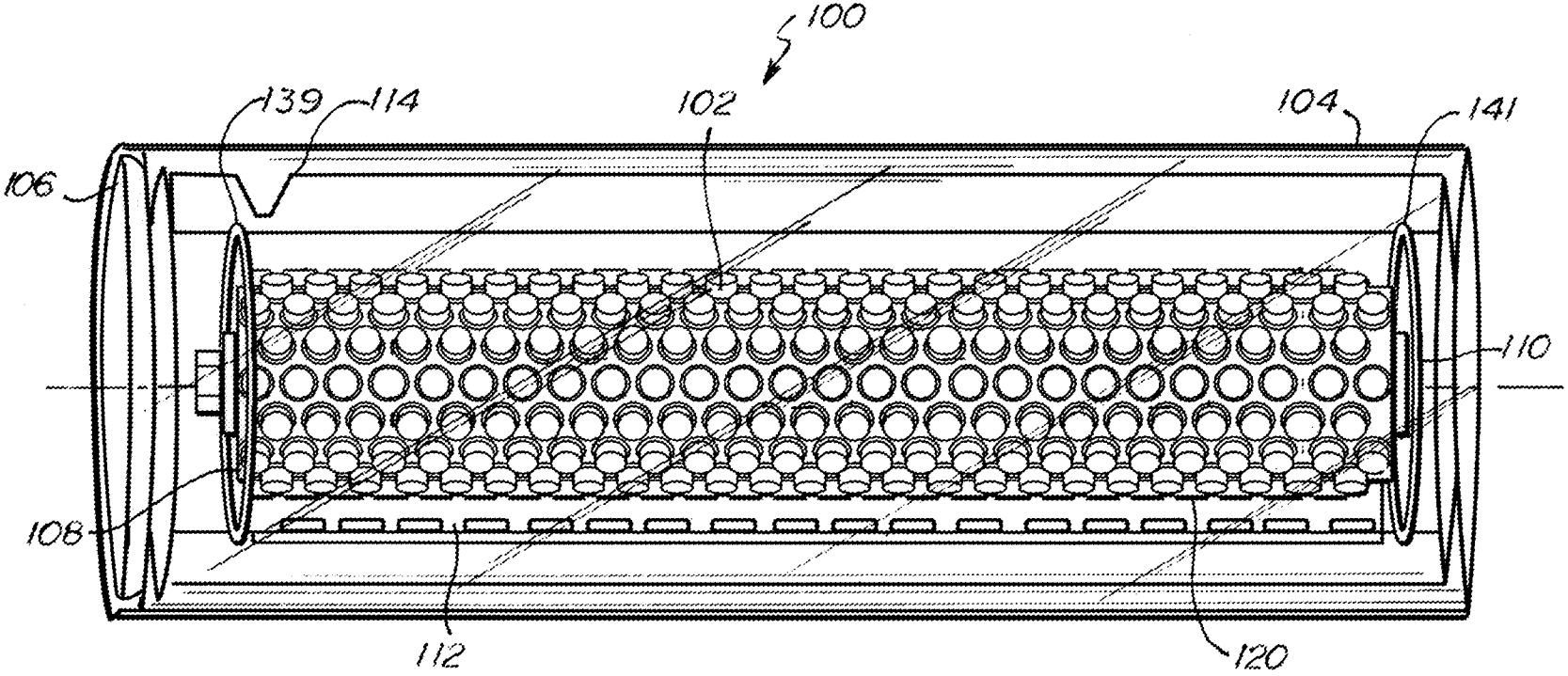
FIG. 1 is a side view of a packaging system for a CMP brush, according to an embodiment of the claimed invention.

While various compositions and methods are described, it is to be understood that this invention is not limited to the particular compositions, designs, methodologies or protocols described, as these may vary. It is also to be understood that the terminology used in the description is for the purpose of describing the particular versions or embodiments only, and is not intended to limit the scope of the present invention which will be limited only by the appended claims.

It must also be noted that as used herein and in the appended claims, the singular forms "a", "an", and "the" include plural reference unless the context clearly dictates otherwise. Thus, for example, reference to a "polymeric container" is a reference to one or more polymeric containers and equivalents thereof known to those skilled in the art, and so forth. Unless defined otherwise, all technical and scientific terms used herein have the same meanings as commonly understood by one of ordinary skill in the art. Methods and materials similar or equivalent to those described herein can be used in the practice or testing of embodiments of the present invention. All publications mentioned herein are incorporated by reference in their entirety. Nothing herein is to be construed as an admission that the invention is not entitled to antedate such disclosure by virtue of prior invention. "Optional" or "optionally" means that the subsequently described event or circumstance may or may not occur, and that the description includes instances where the event occurs and instances where it does not. All numeric values herein can be modified by the term "about," whether or not explicitly indicated. The term "about" generally refers to a range of numbers that one of skill in the art would consider equivalent to the recited value (i.e., having the same function or result). In some embodiments the term "about" refers to ±10% of the stated value, in other embodiments the term "about" refers to ±2% of the stated value. While compositions and methods are described in terms of "comprising" various components or steps (interpreted as meaning "including, but not limited to"), the compositions and methods can also "consist essentially of" or "consist of" the various components and steps, such terminology should be interpreted as defining essentially closed or closed member groups.

As will be described below in greater detail with respect to the Figures, embodiments of the invention include a packaging system for a CMP brush on a core with a protective sleeve or flexible sheet. Unlike known packaging systems, the flexible sheet allows handling of the brush once it is removed from external packaging and enables the user to install the brush on the CMP cleaning tool fittings. The flexible sheet can be removed from the brush and the brush installed on a CMP cleaning tool without the use of cutting tools like scissors. Generally the Figures show a CMP brush that includes a sponge brush on a cylindrical brush core; a flexible sheet comprising a polymeric sleeve that is larger than the brush diameter and that has one or more slits that allow removal of the sleeve from the brush while both brush ends are mounted on a CMP cleaning tool.

The CMP brush further includes end supports that offset the brush surfaces from a surface on which the supports are located and where the end supports are mounted on the ends of the brush. The Figures further show CMP packaging that includes an outer housing, such as a tubular shipping container, with one or more end caps that enclose a polymeric container with a tear notch that can contain a liquid, and that may be liquid tightly sealed with the CMP brush and end supports.

Figure 2:
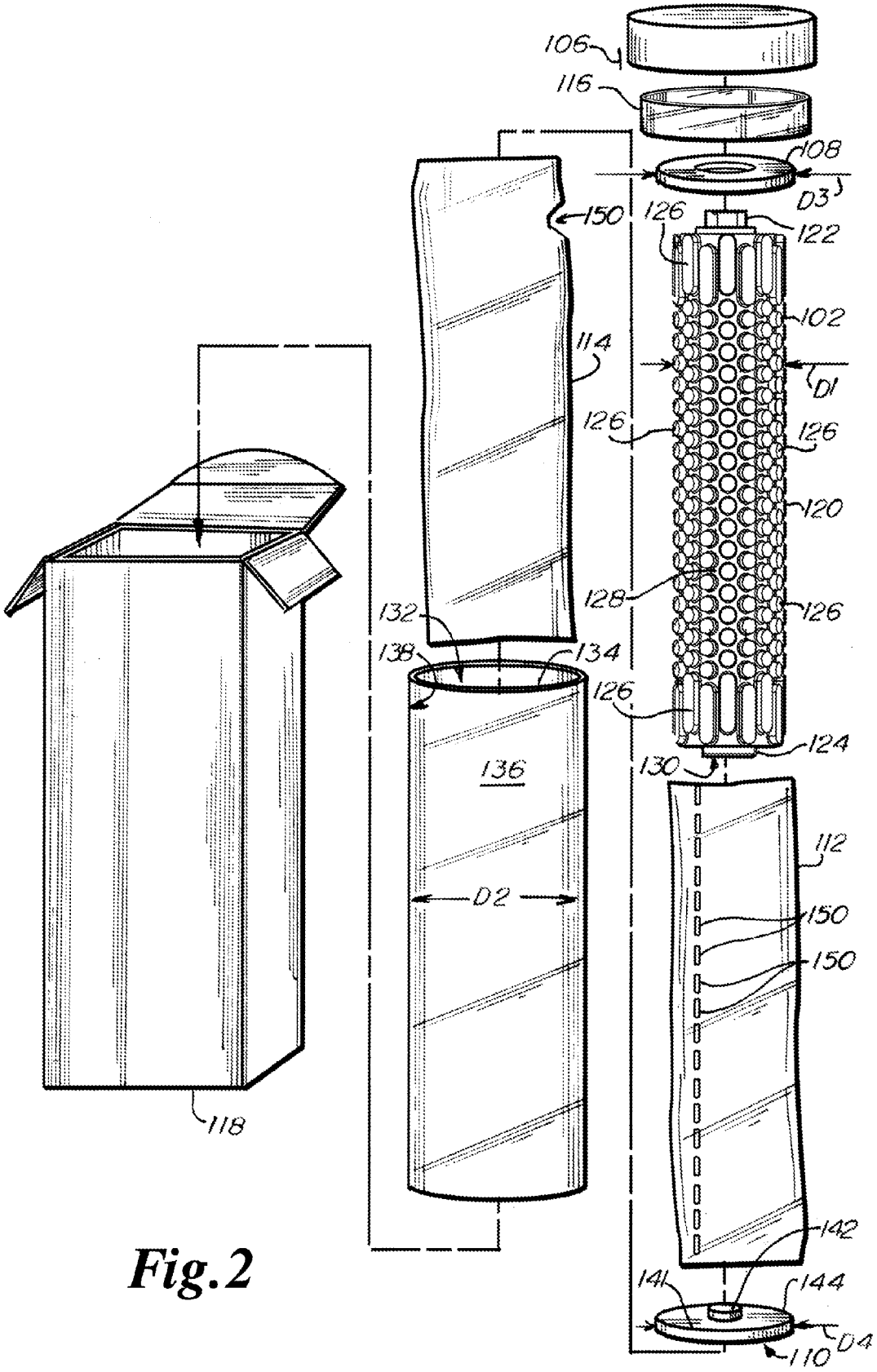
FIG. 2 is an exploded view of the packaging system of FIG. 1.

An embodiment of CMP brush packaging system 100 is depicted in FIGS. 1 and 2. FIG. 1 depicts CMP brush packaging system 100 in a fully-assembled state, while FIG. 2 provides an exploded view of CMP brush packaging system 100.

In the depicted embodiment, CMP brush packaging system 100 encloses brush 102 and includes protective outer housing, which may comprise a tubular shipping container 104 with cap 106, first end support 108, second end support 110, flexible sheet 112, and outer wrap 114. In an embodiment, and as depicted in FIG. 2, packaging system 100 may also include tube cap sealer 116 and external, self-supporting packaging 118.

CMP brush 102 may comprise polyvinyl acetal (PVA), polyurethane, cellulose, or other sponge or foam materials. In an embodiment, CMP brush 102 includes cylindrical brush portion 120, first end-connection portion 122, and second end connection portion 124. Cylindrical brush portion 120 defines an outside diameter D1, and includes a plurality of brush projections or nodules 126 extending outwardly and away from brush surface 128. As will be understood by those of ordinary skill, when CMP brush 102 is attached to a cleaning tool (see also FIG. 8), nodules 126 will contact a substrate to be cleaned. Brush 102, and particularly surface 128 and nodules 126 need to remain clean and contaminant free.

In an embodiment, first end-connection portion 122 comprises a closed end-connection portion, while second end-connection portion 124 comprises an open end-connection portion defining opening 130. In other embodiments, end-connection portions 122 may both be open (such as defining a central aperture), or both be closed (such as no central aperture, or with central projections). First end-connection portion 122 and second end-connection portion 124 may comprise portions of a "core" of brush 102.

Further, CMP brush 102 may be saturated with, or contain, a liquid.

Tubular shipping container 104, in an embodiment comprises a generally cylindrical, rigid structure for enclosing and protecting brush 102. In other embodiments, tubular shipping container 104 may not be cylindrical, but may define a square or rectangular cross section, rather than a circular cross section, such that tubular shipping container 104 more closely resembles a box or carton. In an embodiment, tubular shipping container 104 comprises a polymer material. In an embodiment, tubular shipping container 104 may comprise a self-supporting container.

Tubular shipping container 104 defines inner cavity 132 with cavity opening 134, outer surface 136 and inner surface 138. Tubular shipping container 104 also defines an inside diameter D2, which is greater than brush outside diameter D1.

Cap 106 is configured to couple to tubular shipping container 104 at cavity opening 134 so as to enclose or cap an end of tubular shipping container 104. As will be described further below, cap 106 may be sealed onto tubular shipping container 104. In an embodiment, cap 106 is threaded such that it is configured to turn or screw onto an end of tubular shipping container 104. Although only one cap 106 is depicted at one end of tubular shipping container 104, a second cap 106 may be utilized at a second end of tubular shipping container 104.

Figure 3:
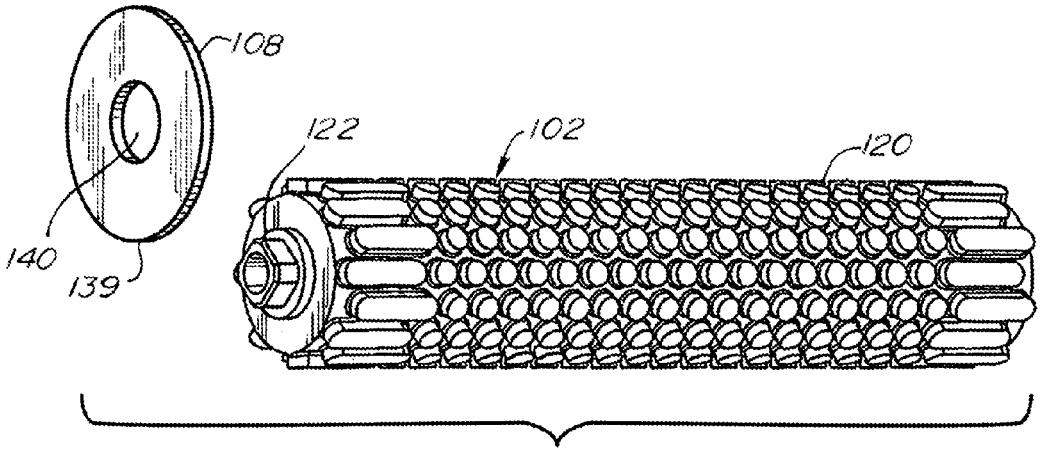
FIG. 3 is a left-side perspective view of a brush and first end support, according to an embodiment of the claimed invention.

Referring also to FIG. 3, first end support 108, in an embodiment, comprises a disk shape including flange portion 139 defining an engagement feature, such as central aperture 140 for receiving first end-connection portion 122, and thereby supportingly engaging end connection portion 122. First end support 108 may comprise a generally rigid polymer material.

First end support 108 defines an outside, or maximum diameter D3. Diameter D3 is generally greater than diameter D1 of brush 102. As such, flange portion 139 extends radially beyond the radial extent of cylindrical portion 120 of brush 102.

Figure 4:
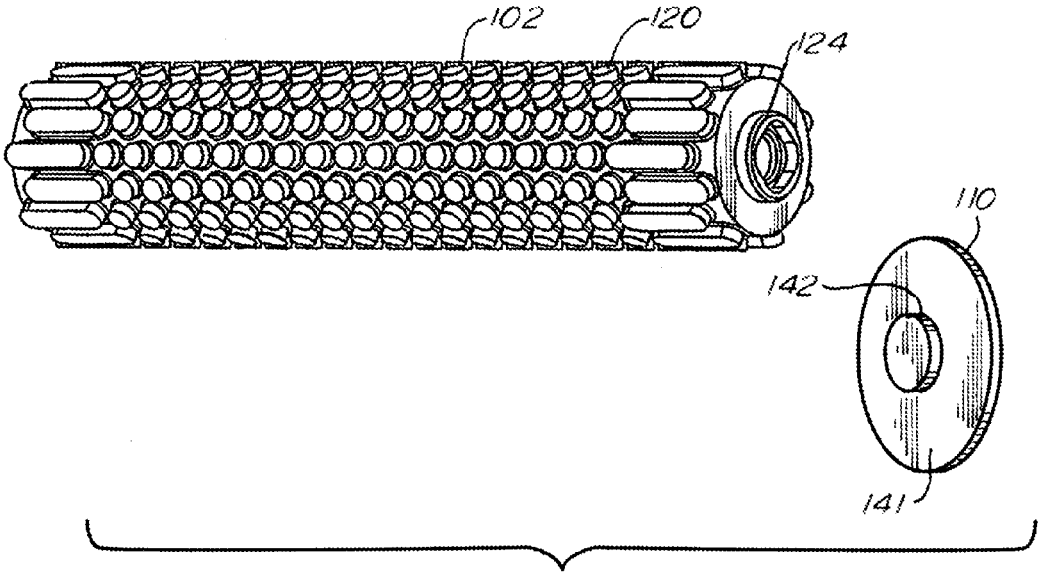
FIG. 4 is a right-side perspective view of the brush of FIG. 3 and a second end support, according to an embodiment of the claimed invention.

Referring also to FIG. 4, second end support 110, in an embodiment, comprises flange portion 141 and central engagement feature or projection 142 projecting outwardly and away from surface 144 of disk portion 140. In an embodiment, projection 142 may be generally cylindrical and hollow. Projection 142 is configured to be received by aperture 130 of second end-connection portion 124, such that second end support 110 is securely coupled to second end-connection portion 124, thereby supportingly engaging end connection portion 124. Further, flange portion 141 extends radially beyond the radial extent of cylindrical portion 120 of brush 102.

Second end support 110 defines an outside, or maximum, diameter D4. Diameter D4 is generally greater than diameter D1 of brush 102, and in an embodiment is equal to diameter D3 of first end support 110.

In the embodiment depicted, first end support 108 is configured to couple to a "closed" embodiment of end connection portion 122, hence the disk-like or washer shape, while second end support 110 is configured to couple to an "open" embodiment of end connection portion 124, hence the disk-like structure with a central projection. However, end supports 108 and 110 may comprise other structures and shapes configured to support ends of brush 102.

End support portion 108, or packaging disk 108, acts as a support or stand-off for CMP brush 102, supportingly engaging end connection portion 122. As described above, end-support 108 may define a hole or other opening, such as aperture 140, that allows it to be mounted around a portion of the brush 102 core, such as end connection portion 122. Other end support portions, such as end support portion 110, may comprise packaging disks that include a nipple or other structure, such as projection 142, that allows it to be inserted into an open end, such as second end connection portion 124, of a brush 102 core.

In an embodiment, and as described briefly above, CMP brush 102 may be saturated with, or include, a liquid. Portions of the liquid may be held within a hollow portion or core of brush 102, and kept within brush 102 by a sealing effect of one or both of end supports 108 and/or 110.

Still referring to FIGS. 1 and 2, CMP brush packaging system 100 also includes flexible sheet 112. Flexible sheet 112 extends around and engages at least some nodules 126 and in some cases, surface 128, of the cylindrical portion 120 of brush 102. In an embodiment, flexible sheet 112 comprises a polymer, for example, a low density polyethylene (LDPE), inner sleeve. In an embodiment, flexible sheet 112 may also include perforations 150 or multiple slits along an edge of flexible sheet 112. Other longer or shorter slits 150 that allow the sleeve to be removed from the brush (while both ends of the brush are mounted to a CMP cleaning tool) without touching the brush could also be used. For example a spiral perforation around flexible sheet 112 could be used, or a loose spiral wrapping of a polymeric film about the brush could constitute a continuous slit of the sleeve. The sleeve can be a polymeric wrap, for example a polyethylene film, polypropylene, or other clean (low particle shedding, low ionic metals (less than 100 parts per billion), and low organics (below 100 parts per billion) which allows handling of the covered brush, but can be removed after brush installation.

In an embodiment, flexible sheet 112 is loose fitting on the brush 102 which in some embodiments allows a user to grasp flexible sheet 112 above perforations or slits 150 while still allowing the user to hold brush 102 and flexible sheet 112.

Figure 8:
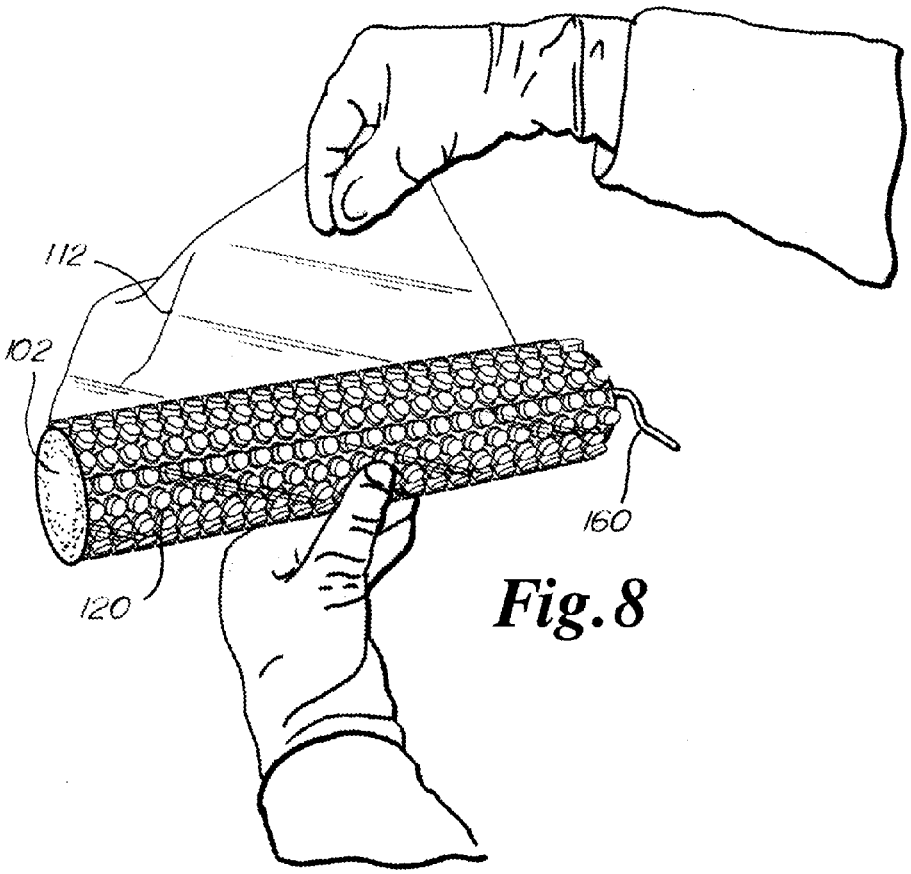
FIG. 8 is a perspective view of a user removing a flexible sheet from a brush attached to a tool.

In yet another embodiment, flexible sheet 112, rather than comprising a sleeve, comprises a flexible wrapping material that is wrapped about cylindrical portion 120 of brush 102, thereby contacting nodules 126 and covering nodules 126 and surface 128, thereby protecting and keeping brush 102 free from contaminates (see also FIG. 8).

In yet another embodiment, flexible sheet 112 comprises a semi-rigid plastic sleeve with a single slit along its length, rather than perforations 150. A semi rigid sleeve would allow handling and protection of the brush during installation on the tool, but also allow for easy removal from the brush afterwards.

Outer wrap 114 may comprise an outer polymeric container or polymeric bag, which may optionally have a polyethylene interior and a nylon exterior. In an embodiment, outer wrap 114 may define a "V"-shaped tear notch 150 for scissor-free opening of the outer wrap or bag. Notch 150 avoids possible contamination by a tool, such as scissors, that may be used to open outer wrap 114. In an embodiment, outer wrap 114 also serves to keep liquid of brush 102 from migrating away or evaporating from cylindrical brush portion 120. In an embodiment, outer wrap 114 creates a hermetic seal about brush 102.

In the depicted embodiment, outer wrap 114 encloses brush 102 coupled to end supports 108 and 110, and wrapped with "inner" flexible sheet 112. Outer wrap 114 with enclosed brush 102 is received into cavity 132 of tubular shipping container 104.

Figure 5:
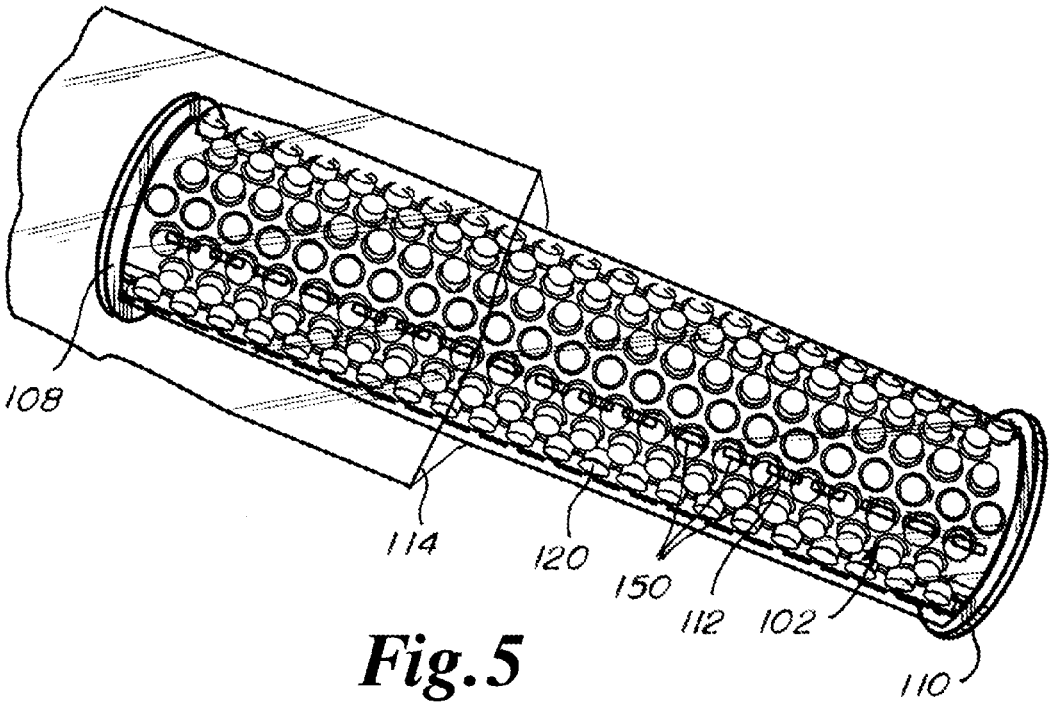
FIG. 5 is a front view of a subassembly of a brush with end supports, the brush wrapped in a flexible sheet, and partially inserted into an outer wrap, and a tubular shipping container, according to an embodiment of the claimed invention.
Figure 5A:
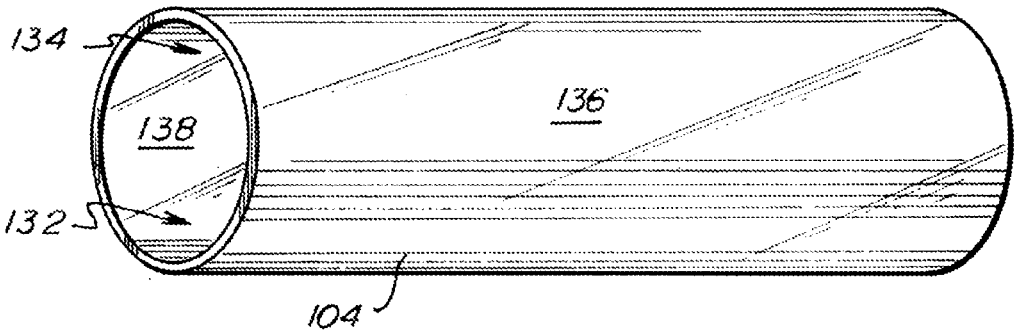

Referring also to FIG. 5, brush 102 coupled to end supports 108 and 110, with cylindrical portion 120 covered with flexible sheet 112, is depicted as partially inserted into outer wrap 114. In the depicted embodiment, outer wrap 114 comprises a sleeve or bag having an opening into which wrapped brush 102 may be inserted.

FIG. 5 also depicts a perspective view of tubular shipping container 104, presenting outside surface 136 and inside surface 138. As described above, brush 102 coupled to end supports 108 and 110, with cylindrical portion 120 wrapped in flexible sheet 112, and wrapped in outer wrap 114, may be inserted through opening 134 into tubular shipping container 104. It should be noted that although tubular shipping container 104 is depicted as open only at one end, which is subsequently capped, tubular shipping contain 104 may be open at both opposing ends, which, in an embodiment, would both be subsequently capped and sealed.

In an alternate embodiment, brush 102 coupled to end supports 108 and 110, and wrapped with "inner" flexible sheet 112 is placed directly into tubular shipping container 104, and tubular shipping container 104 is received into outer wrap 114.

Referring again to FIGS. 1 and 2, cap 106 is configured to be inserted onto tubular shipping container 104, and may be sealed to tubular shipping container 104 to avoid moisture, dirt, and other contaminants from migrating into tubular shipping container 104. In an embodiment, cap 106 is sealed to tubular shipping container 104 via tube cap sealer 116. Tube cap sealer 116 may comprises any of a variety of materials, including adhesive tape, mylar, PVC shrink bands, and so on. In an embodiment, cap 106 affixed to tubular shipping container 104 creates a hermetic seal.

In an embodiment, and as depicted in FIG. 2, CMP brush packaging system 100 may also include exterior self-supporting packaging 118. In an embodiment, self-supporting packaging 118 comprises a carton, such as a shipping carton, or other such self-supporting carton, box, or container. In an embodiment, self-supporting packaging 118 may comprise a cardboard box having a square end shape. When present, exterior self-supporting packaging 118 is configured to receive tubular shipping container 104 and its sealed contents, including brush 102 coupled to end supports 108 and 110, flexible sheet 112 and in some embodiments, outer wrap 114.

As such, embodiments of CMP brush packaging system 100 provide multiple sources of protection: mechanical protection via an outer housing, such as a tubular shipping container, chemical protection, including liquid sealing via a polymeric container or polymeric bag, such as outer wrap 114, and protection during installation via flexible sheet 112, of the brush on a CMP cleaning tool.

Referring specifically to FIG. 1, brush 102 is secured within tubular shipping container 104. Because flanges 139 and 141 extend radially beyond the radial extent of cylindrical brush portion 120, i.e., D2 and D3 are larger than D1 (referring to FIG. 2), brush 102 is suspended within the cylindrical space of tubular shipping container 104. Although not depicted, in an embodiment, end supports 108 and 110 engage inside surface 138 of tubular shipping container 104.

Referring to FIGS. 1 and 2, another embodiment of the claimed invention includes a method of packaging a CMP brush 102 having a cylindrical brush portion 120 and a pair of end connection portions 108 and 110. In an embodiment, the method includes saturating brush 102 with a liquid, covering cylindrical brush portion 120 with flexible sheet 112 that extends around and engages the surface of cylindrical portion 120, engaging each of the end connection portions 108 and 110 with a respective end support 122 and 124, inserting the dampened brush 102 into a rigid polymer tubular shipping container, such as tubular shipping container 104. In an embodiment, the method also includes supporting end connection portions 122 and 124 within tubular shipping container 104. In an embodiment, the method also includes providing an additional exterior self-supporting packaging, such as carton 118.

Another embodiment of the invention is a method of unpacking and installing a CMP brush that is partially enclosed in a sleeve with one or more slits onto a cleaning tool. The method can include the act or step of removing the sleeve from the brush after it has been installed on the cleaning tool by opening the sleeve along the one or more slits.

More specifically, in an embodiment, the method includes: opening carton 118; removing brush 102 packaging from carton 118, wherein brush 102 packaging may include brush 102 with end supports 108 and 110, and flexible sheet 112, surrounded by outer wrap 114; locating a tear indicator, such as V-notch 150, on outer wrap 114; tearing outer wrap 114 open; and removing tubular shipping container 104 from outer wrap 114. In an embodiment, these last two steps may be reversed.

The method may further include removing cap sealer 116 from cap 106 and tubular shipping container 104; removing cap 106 from tubular shipping container 104; removing a brush assembly that includes brush 102 coupled to end supports 108 and 110, with cylindrical brush portion 120 wrapped with flexible sheet 112; removing first end support 108; and removing second end support 110.

Figure 6:
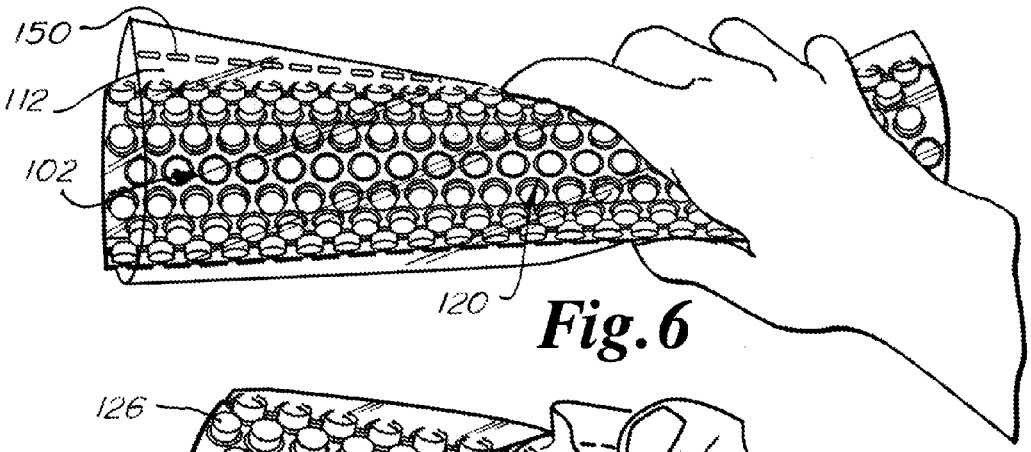
FIG. 6 is a front view of a user grasping a CMP brush wrapped in a flexible sheet.

Referring also to FIG. 6, the method may also include grasping cylindrical portion 120 while contacting flexible sheet 112, but without contacting surface 128 or nodules 126 of brush 102.

Figure 7:
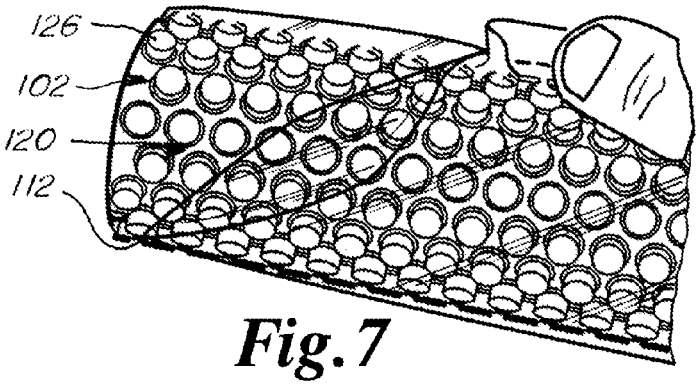
FIG. 7 is a perspective view of a flexible sheet being torn along a perforated edge.

Referring also to FIG. 7, the method may also include tearing flexible sheet 112 along a perforated edge. Tearing of flexible sheet 112 may occur before, during, or after the step of mounting brush 102 onto a tool (see also FIG. 8, depicting brush 102 mounted to a tool 160).

Referring to FIG. 8, the method also includes removing flexible sheet 112 from brush 102, again, without having to touch nodules 126 or surface 128 of brush 102.

In another similar embodiment, the claimed invention comprises a method of unpacking and installing a CMP brush, from a CMP package, the CMP package comprising the CMP brush having a dampened cylindrical foam portion and two opposite end-connection portions, the packaging comprising a polymer sheet material wrapping and engaging the cylindrical portion, a pair of end support portions engaging the opposite end portions of the CMP and engaged with a self-supporting shipping container; the method comprising: removing the CMP brush with supports from the self-supporting polymer shipping container, removing the end supports from the cylindrical brush while retaining the polymer sheet material wrapping the cylindrical brush portion, manually grasping the cylindrical brush by way of the polymer sheet material wrapping the cylindrical brush portion such the surface of the brush portion is not contacted by the users hand; affixing the brush to the brush fixture whilst holding the cylindrical brush by way of the polymer sheet, and removing the polymer sheet.

In another embodiment, an embodiment of this method may also include the polymer sheet being configured as a sleeve and removing the polymer sheet is accomplished by tearing a tear portion in the polymer sleeve and then removing the sleeve.

The claimed invention includes a number of embodiments, including a method of packaging a CMP brush having a cylindrical brush portion and a pair of end connection portions, the method comprising: at least dampening the brush with a liquid; covering the cylindrical brush portion with a flexible sheet that extends around and engages the surface of the cylindrical portion; engaging each of the end connection portions with a respective end support, the end supports having a flange portion with a diameter greater than a maximum diameter of the cylindrical portion; inserting the dampened brush into a rigid polymer tubular shipping container having a tubular wall with an inside surface, whereby the end supports keep the cylindrical brush portion from contact and from deformation of the cylindrical portion by the tubular wall; and providing an additional exterior self-supporting packaging around the rigid polymer shipping container.

In an embodiment, the method may also comprise applying an additional polymer sheet wrap covering to the exterior of the polymer tube with the end connection portions supported therein.

In an embodiment, the method may also comprise selecting the additional sheet wrap material to have shrink wrap capabilities and heating the additional sheet wrap to shrink it thereby hermetically sealing the brush therein.

In an embodiment, the method may also comprise selecting a sleeve as the flexible sheet to extend around the cylindrical portion and covering the cylindrical portion comprising insertion of the brush into the sleeve.

Such an embodiment may also comprise selecting the sleeve to have one of a tear conducive region or a slit.

In an embodiment, the method may also comprise selecting a cardboard box with a square shape on the end view as the additional exterior self-supporting packaging.

In an embodiment, the method may also comprise selecting end support portions having a flange portion being disk shaped and having central engagement structure for engagement with the axial center of the brush.

In an embodiment, the method may also comprise providing an addition sealed polymer bag as packaging.

In an embodiment, the method may also comprise inserting the support portions inside the polymer tubular shipping container and installing a rigid cap on each open end of the tubular shipping container.

In an embodiment, the method may also comprise hermetically sealing the rigid cap.

In an embodiment, the claimed invention may also comprise a packaged CMP brush, the brush comprising a cylindrical brush portion with a cylindrical surface and a pair of end connection portions, the packaging comprising: a flexible polymer sheet material extending around the cylindrical portion and circumferentially engaging and covering the cylindrical portion; a pair of end support portions supportingly engaging each of the end connection portions, each end support portion having a central engagement feature in engagement with the end connection portion and a flange portion extending radially beyond the radial extent of the cylinder; a rigid polymer shipping container, the end support portions engaging the ends of the polymer shipping container whereby the brush is suspended therein with the cylindrical surface spaced from the rigid polymer shipping container; and the rigid polymer shipping container hermetically sealed.

In an embodiment, the hermetic seal is provided by an additional polymer sealed bag, or is provided by polymer shrink wrap covering the rigid polymer shipping container.

In an embodiment, the rigid polymer shipping container is configured as rigid tube and wherein the end supports are engaged with ends of the tube.

In an embodiment, the packaging further comprises a cardboard box with a square end shape, the brush enclosed therein.

In an embodiment, the flexible polymer sheet material extending around the cylindrical portion is configured as a sleeve.

In an embodiment, the sleeve has structure facilitating opening, the structure comprising at least one of a slit, perforations, and a tear-conducive region.

In an embodiment the flexible polymer sheet material extending around the cylindrical portion is a rectangular sheet rolled up on the cylindrical portion.

In an embodiment, the claimed invention also includes a method of unpacking and installing a CMP brush, from a CMP package, the CMP package comprising the CMP brush having a dampened cylindrical foam portion and two opposite end portions, the packaging comprising a polymer sheet material wrapping and engaging the cylindrical portion, a pair of end support portions engaging the opposite end portions of the CMP and engaged with a self-supporting shipping container; the method comprising: removing the CMP brush with supports from the self-supporting polymer shipping container, removing the end supports from the cylindrical brush while retaining the polymer sheet material wrapping the cylindrical brush portion, manually grasping the cylindrical brush by way of the polymer sheet material wrapping the cylindrical brush portion such the surface of the brush portion is not contacted by the users hand; affixing the brush to the brush fixture whilst holding the cylindrical brush by way of the polymer sheet material, and removing the polymer sheet material.

In an embodiment, the polymer sheet is configured as a sleeve and removing the polymer sheet is accomplished by tearing a tear portion in the polymer sleeve and then removing the sleeve.

In an embodiment, the claimed invention comprises a method of packaging a CMP brush having a cylindrical brush portion with radially extending nodules and a pair of end connection portions, the method comprising: covering the cylindrical brush portion with a flexible sheet that extends around and engages the nodules without deforming the nodules; engaging each of the end connection portions with a respective end support, the end supports having a flange portion with a diameter greater than a maximum diameter of the cylindrical portion; inserting the brush into a rigid polymer tubular shipping container having a tubular wall with an inside surface, whereby the end supports keep the nodules from contact and from deformation of the cylindrical portion by the tubular wall; and providing an additional exterior self-supporting packaging around the rigid polymer shipping container.

In an embodiment, the claimed invention also comprises a method of shipping a CMP brush having a cylindrical brush portion with nodules and a pair of end connection portions, the method comprising: providing three polymer coverings to the cylindrical brush portion: one being a non-self-supporting wrap wrapped around the cylindrical portion and engaging the nodules; another one being a sealed bag; and the final one being a tubular shipping container sized with an inside diameter larger than a maximum diameter of the brush portion; enclosing the cylindrical brush portion within the three polymer coverings.

In an embodiment the method further comprises spacing the CMP brush from the tubular shipping container inside the container.

In an embodiment, the claimed invention also comprises a method of protecting a CMP brush having a cylindrical brush portion with radially extending nodules and a pair of end connection portions, the method comprising: having the brush dampened; wrapping the cylindrical brush portion and nodules with a non-self supporting wrap whereby the cylindrical brush may be grasped by a user's hand without the hand directly contacting the brush.

An embodiment of such a method may also include placing the brush inside a tubular shipping container with the nodules spaced from a wall of the container.

An embodiment of such a method may also include engaging each of the end connection portions with a respective end support, the end supports having a flange portion with a diameter greater than a maximum diameter of the cylindrical portion; and providing an additional exterior self-supporting packaging around the rigid polymer shipping container.

In an embodiment, the claimed invention comprises a packaged CMP brush, the brush having a cylindrical brush portion with nodules and a pair of end connection portions, the packaging comprising: three polymer coverings to the cylindrical brush portion, the three polymer coverings comprising: a non-self supporting wrap wrapped around the cylindrical portion and engaging the nodules without deforming the nodules; a sealed bag; and a rigid tubular shipping container sized with an inside diameter larger than a maximum diameter of the brush portion; wherein the CMP brush is sealingly enclosed in the rigid tubular shipping container and spaced from a tubular wall of the container.

Although the invention has been shown and described with respect to one or more implementations, equivalent alterations and modifications will occur to others skilled in the art based upon a reading and understanding of this specification and the annexed drawings. The invention includes all such modifications and alterations and is limited only by the scope of the following claims. In addition, while a particular feature or aspect of the invention may have been disclosed with respect to only one of several implementations, such feature or aspect may be combined with one or more other features or aspects of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising." Also, the term "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated herein.

Although the present invention has been described in considerable detail with reference to certain embodiments thereof, other versions are possible. Therefore the spirit and scope of the appended claims should not be limited to the description and the versions contain within this specification.

What is claimed is:

1. A packaged chemical mechanical planarization (CMP) brush comprising:

a wrapped dampened CMP brush comprising:

a cylindrical brush portion with a cylindrical surface and a pair of end connection portions, a flexible polymer sheet material extending around the cylindrical brush portion and circumferentially engaging and covering the cylindrical brush portion, said flexible polymer sheet material including a perforation configured to remove the flexible polymer sheet material from the cylindrical brush portion, and said flexible polymer sheet material extending around the cylindrical brush portion such that the wrapped dampened CMP brush is mountable on a CMP tool;

a pair of end support portions supportingly engaging each of the end connection portions, each end support portion having a central engagement feature in engagement with the end connection portion and a flange portion extending radially beyond the radial extent of the cylindrical surface;

an outer wrap that encloses said pair of end support portions and hermetically seals the wrapped dampened CMP brush, the end support portions configured to engage the ends of a rigid polymer shipping container whereby the brush is suspended therein with the cylindrical surface spaced from the rigid polymer shipping container; and one or more end caps that enclose the rigid polymer shipping container.

2. The packaged CMP brush of claim 1, wherein the perforation of the flexible polymer sheet material is a spiral perforation.

3. The packaged CMP brush of claim 1, wherein the flexible polymer sheet material is configured to loosely wrap around the cylindrical brush portion and the perforation is a continuous slit.

4. The packaged CMP brush of claim 1, wherein the rigid polymer shipping container is configured as a rigid tube and wherein the end support portions are engaged with ends of the tube.

5. The packaged CMP brush of claim 1, further comprising a cardboard box with a square end shape, the CMP brush enclosed therein.

6. The packaged CMP brush of claim 1, wherein the flexible polymer sheet material extending around the cylindrical brush portion is a rectangular sheet rolled up on the cylindrical brush portion.

* * * * *